US009488948B2

(12) United States Patent
Kitamura et al.

(10) Patent No.: US 9,488,948 B2
(45) Date of Patent: Nov. 8, 2016

(54) IMAGE FORMING APPARATUS THAT DETECTS DETERIORATION OF A COMPONENT AND DETERMINES LIFE OF THE COMPONENT

(71) Applicant: CANON KABUSHIKI KAISHA, Tokyo (JP)

(72) Inventors: Toshifumi Kitamura, Numazu (JP); Satoru Taniguchi, Mishima (JP); Wataru Uchida, Yokohama (JP); Hiroyuki Yamazaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/686,624

(22) Filed: Apr. 14, 2015

(65) Prior Publication Data

US 2015/0301498 A1 Oct. 22, 2015

(30) Foreign Application Priority Data

Apr. 18, 2014 (JP) ..... 2014-086848

(51) Int. Cl.

| | |
|---|---|
| ***G03G 15/00*** | (2006.01) |
| ***G03G 21/20*** | (2006.01) |
| ***B65H 7/20*** | (2006.01) |
| ***B65H 7/02*** | (2006.01) |

(52) U.S. Cl.

CPC ..... *G03G 15/55* (2013.01); *B65H 7/02* (2013.01); *B65H 7/20* (2013.01); *G03G 21/203* (2013.01)

(58) Field of Classification Search

CPC ..... G03G 15/553; G03G 15/55
USPC ..... 399/24
See application file for complete search history.

(56) References Cited

U.S. PATENT DOCUMENTS

| | | | | |
|---|---|---|---|---|
| 7,676,164 | B2 * | 3/2010 | Shiori | G03G 15/553 399/24 |
| 7,792,479 | B2 * | 9/2010 | Yasumoto | |
| 2005/0141903 | A1 * | 6/2005 | Kwon | G03G 15/55 399/24 |
| 2006/0115281 | A1 * | 6/2006 | Kim | |

FOREIGN PATENT DOCUMENTS

| | | | | |
|---|---|---|---|---|
| JP | 04-277780 | A | | 10/1992 |
| JP | 08-262822 | A | | 10/1996 |
| JP | 11133770 | A | * | 5/1999 |
| JP | 2010-210801 | A | | 9/2010 |
| JP | 2011191421 | A | * | 9/2011 |

* cited by examiner

*Primary Examiner* — Walter L Lindsay, Jr.
*Assistant Examiner* — Milton Gonzalez
(74) *Attorney, Agent, or Firm* — Canon U.S.A., Inc. IP Division

(57) ABSTRACT

An image forming apparatus includes a fixing unit that fixes an image, an obtaining unit that obtains information regarding conveying time taken to convey a recording material, a detection unit that detects information regarding an environment, and a control unit configured to determine, based on the information regarding the conveying time and the information regarding the environment, a timing at which the fixing unit is replaced.

10 Claims, 11 Drawing Sheets

| HUMIDITY | |
|---|---|
| LOWER THAN 50% | 50% OR HIGHER |
| $\alpha = 1$ | $\alpha = 0.8$ |

FIG. 9

| NUMBER OF SHEETS SUBJECTED TO PRINTING OPERATION (IN PRINTING JOB) | HUMIDITY | |
|---|---|---|
| | LOWER THAN 50% | 50% OR HIGHER |
| FIRST TO TENTH SHEETS | $\alpha = 1$ | $\alpha = 0.7$ |
| ELEVENTH SHEET OR LATER | $\alpha = 1$ | $\alpha = 0.8$ |

IMAGE FORMING APPARATUS THAT DETECTS DETERIORATION OF A COMPONENT AND DETERMINES LIFE OF THE COMPONENT

BACKGROUND

Field

Aspects of the present invention generally relate to an image forming apparatus that forms an image on a recording material and detection of a deterioration state of a conveying unit that conveys the recording material.

Description of the Related Art

In an image forming apparatus, a deterioration state (also referred to as "life") of a conveying unit, such as a conveying roller, that conveys a recording material on which an image is formed is generally determined based on the total number of sheets of the recording material conveyed by the conveying unit, the total driving time of the conveying unit, changes in speed at which the recording material is conveyed, or the like. A threshold used in the determination of the life of the conveying unit is set such that the performance of the conveying unit in conveying the recording material does not affect the quality and functions (for example, image quality, conveying performance, and the like) of the image forming apparatus. For example, in Japanese Patent Laid-Open No. 4-277780, a technique is proposed in which the speed at which the recording material is conveyed by a fixing unit, which is an example of the unit that conveys a recording material, is detected, and the life of the fixing unit is determined based on the amount of change from an initial value (initial conveying speed) before deterioration of the fixing unit due to repeated use.

The performance of the conveying unit in conveying the recording material, however, changes depending on other factors such as an environment (temperature, humidity, and the like) in which the image forming apparatus is installed, as well as the deterioration due to repeated use.

SUMMARY OF THE INVENTION

Aspects of the present invention generally make it possible to accurately determine the life of a conveying unit while taking into consideration factors in changes in the conveying performance of the conveying unit other than repeated use, which deteriorates the conveying performance.

An image forming apparatus according to an aspect of the present invention includes a fixing unit configured to fix an image onto a recording material, an obtaining unit configured to obtain information regarding conveying time taken to convey the recording material, a detection unit configured to detect information regarding an environment, and a control unit configured to determine, based on the information regarding the conveying time and the information regarding the environment, a timing at which the fixing unit is replaced.

Further features of the present disclosure will become apparent from the following description of exemplary embodiments with reference to the attached drawings.

BRIEF DESCRIPTION OF THE DRAWINGS

FIG. 9 is a diagram illustrating a relationship between humidity and a correction coefficient according to the second embodiment.

DESCRIPTION OF THE EMBODIMENTS

Exemplary embodiments will be described hereinafter with reference to the drawings. It is to be noted that the following embodiments are not seen to be limiting, and not all combinations of characteristics described in the embodiments are necessary in order to practice the exemplary embodiments.

First Exemplary Embodiment

Figure 1A:
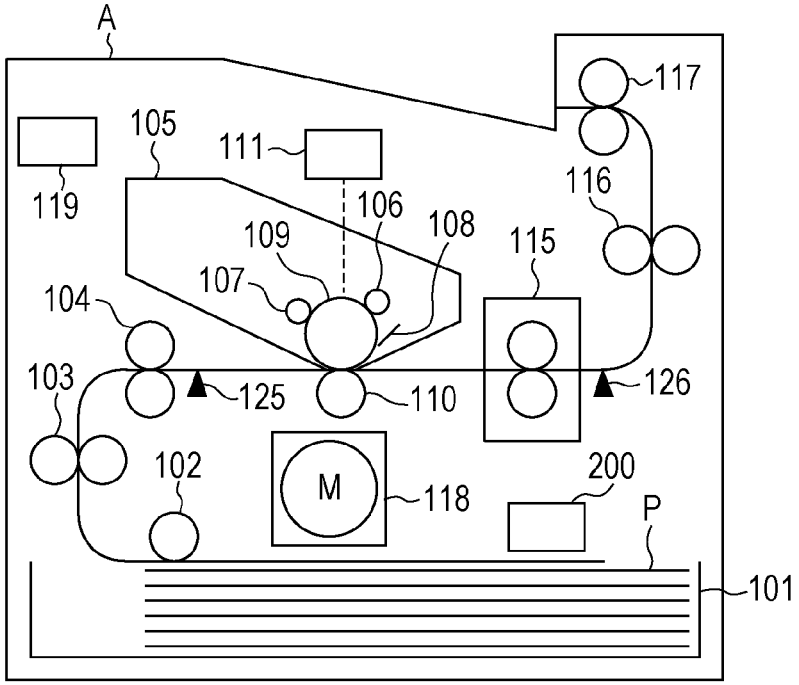
FIGS. 1A and 1B are diagrams illustrating an exemplary image forming apparatus.

FIG. 1A illustrates the configuration of an image forming apparatus A (hereinafter referred to as a "body A"). A recording material (hereinafter referred to as a "recording material P") stored in a paper cassette 101 is conveyed to a cartridge 105, which is an image forming unit, at a certain timing through a pickup roller 102, feed rollers 103, and registration rollers 104. The cartridge 105 integrally includes a charging roller 106, which is a charging section, a developing roller 107, which is a developing section, a cleaning unit 108, and a photosensitive drum 109, which is an image bearing member. The cartridge 105 is removably attached to the body A. An exposure unit 111 outputs laser light to form an electrostatic latent image on the photosensitive drum 109, and the electrostatic latent image on the photosensitive drum 109 is developed as a toner image. A transfer unit 110 transfers the toner image on the photosensitive drum 109 onto the recording material P. A fixing unit 115 heats and pressurizes the recording material P to fix the toner image onto the recording material P. Thereafter, the recording material P, on which the image has been formed, is discharged from the body A through intermediate discharge rollers 116 and discharge rollers 117. Thus, a printing operation ends.

A motor 118 is a driving unit that drives components including the fixing unit 115. A first conveying sensor 125 and a second conveying sensor 126, which are detection units for detecting a conveying state of the recording material P, are provided along a conveying path for the recording material P. The body A also includes a temperature/humidity sensor 119 that detects an environment. The temperature/humidity sensor 119 can detect the temperature and humidity of atmosphere around the body A. A control unit 200 optimizes image forming conditions and the like in accordance with a result of the detection performed by the temperature/humidity sensor 119. The body A is controlled based on a control program (not illustrated) stored in a storage section (read-only memory (ROM)) 200*a* of the control unit 200 included therein.

Figure 1B:
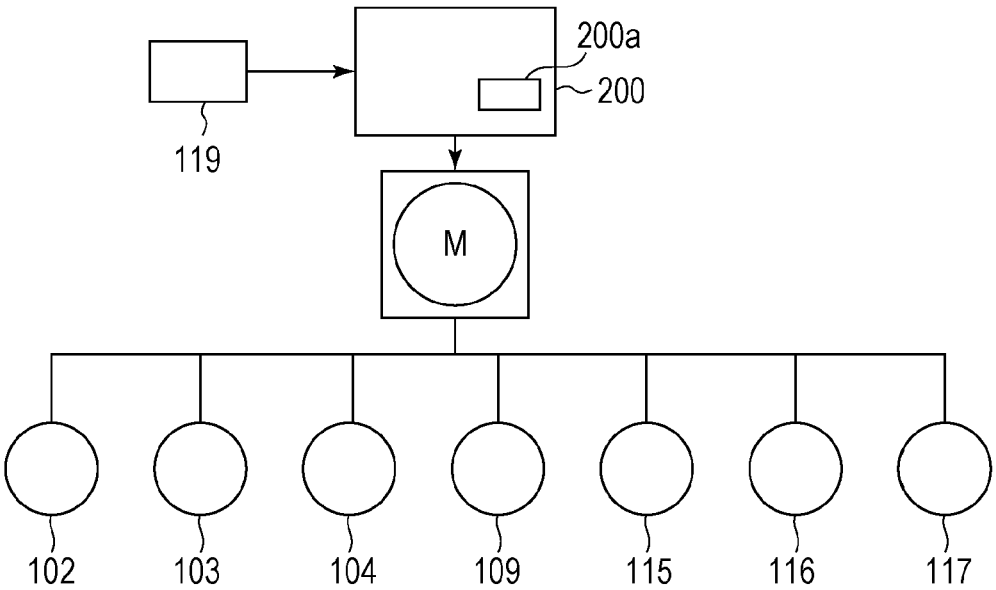

FIG. 1B illustrates a connection relationship between the control unit 200, the temperature/humidity sensor 119, the motor M, the rollers 102, 103, 104, 116, and 117, the photosensitive drum 109, and the fixing unit 115 in the image forming apparatus A. The control unit 200 receives signals from the temperature/humidity sensor 119 and the conveying sensors 125 and 126. The control unit 200 outputs a signal for instructing the motor M to start or stop driving. The motor M drives the rollers 102, 103, 104, 116, and 117 and the photosensitive drum 109 based on the signal.

Figure 2:
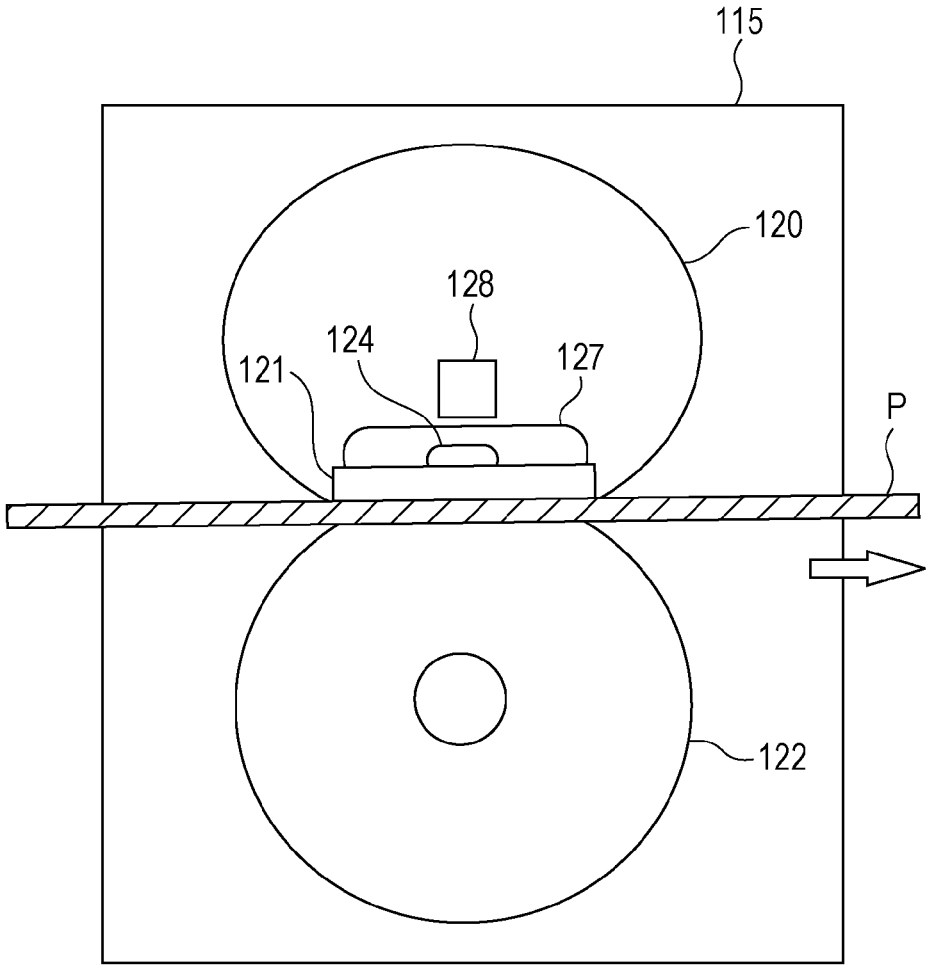
FIG. 2 is a schematic diagram illustrating an exemplary fixing unit.

In the present embodiment, the fixing unit 115 will be described as an example of a replaceable conveying unit. FIG. 2 is a side view of the fixing unit 115. The fixing unit 115 adopts a known film method and includes a ceramic heater 121 and a holding member (not illustrated) for the ceramic heater 121 in a fixing film 120. The ceramic heater 121 faces a pressure roller 122. Thermal grease is applied to a surface of the ceramic heater 121 in contact with the fixing film 120 to increase sliding performance between the ceramic heater 121 and the fixing film 120. A heating element 124 is coated by a glass protection film 127, which is an electrical insulation layer. A thermistor 128, which is a sensor for detecting the temperature of the ceramic heater 121, is provided at the center of the ceramic heater 121 in a longitudinal direction.

Figure 3:
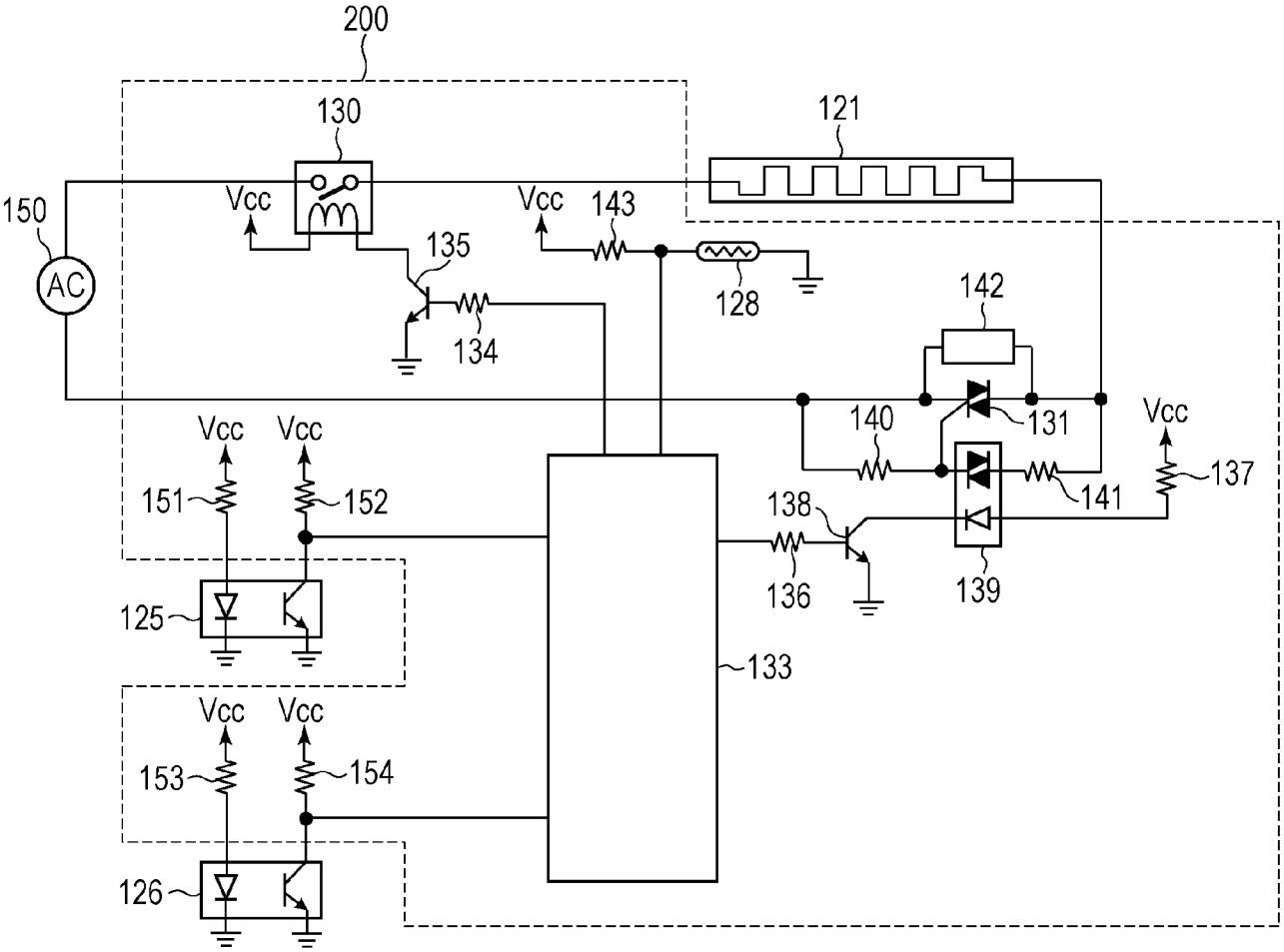
FIG. 3 is a diagram illustrating a driving circuit of the fixing unit and detection circuits of conveying sensors.

FIG. 3 illustrates the control unit 200 and part of surrounding circuits, that is, a driving circuit of the fixing unit 115 and detection circuits of the first conveying sensor 125 and the second conveying sensor 126, according to the present embodiment. In FIG. 3, a relay 130, the ceramic heater 121, and a triode for alternating current (TRIAC) 131 are connected to a commercial power supply 150. The relay 130 closes an electrical line to the ceramic heater 121 and is driven by a relay driving circuit (a resistor 134 and a transistor 135) in accordance with a driving signal from a central processing unit (CPU) 133. The relay 130 is used for stopping supplying electricity to the ceramic heater 121 when the ceramic heater 121 is abnormal.

The TRIAC 131 starts or stops supplying electricity to the ceramic heater 121. The CPU 133 drives a TRIAC driving circuit (resistors 136 and 137 and a transistor 138) to turn on a light-emitting diode (LED) of a phototriac coupler 139. If the LED of the phototriac coupler 139 lights, the phototriac coupler 139 turns on, and bias resistors 140 and 141 of the TRIAC 131 turn on the TRIAC 131. A surge protection component 142 is provided for the TRIAC 131.

The thermistor 128 detects the temperature of the ceramic heater 121, and the CPU 133 monitors the temperature. The CPU 133 receives an analog voltage value obtained as a result of division performed by the thermistor 128 and a resistor 143. The CPU 133 controls the driving of the TRIAC 131 based on the received voltage value (temperature information) in such a way as to keep the temperature of the ceramic heater 121 constant.

In the present embodiment, photointerrupters are used as the first conveying sensor 125 and the second conveying sensor 126. A surrounding circuit of the photointerrupters includes resistors 151 and 153 and pull-up resistors 152 and 154 for limiting current. A member (a flag or the like) provided along the conveying path of the recording material P blocks an optical path of each photointerrupter. The CPU 133 receives signals from the first conveying sensor 125 and the second conveying sensor 126 and determines presence or absence of the recording material P.

Figure 4:
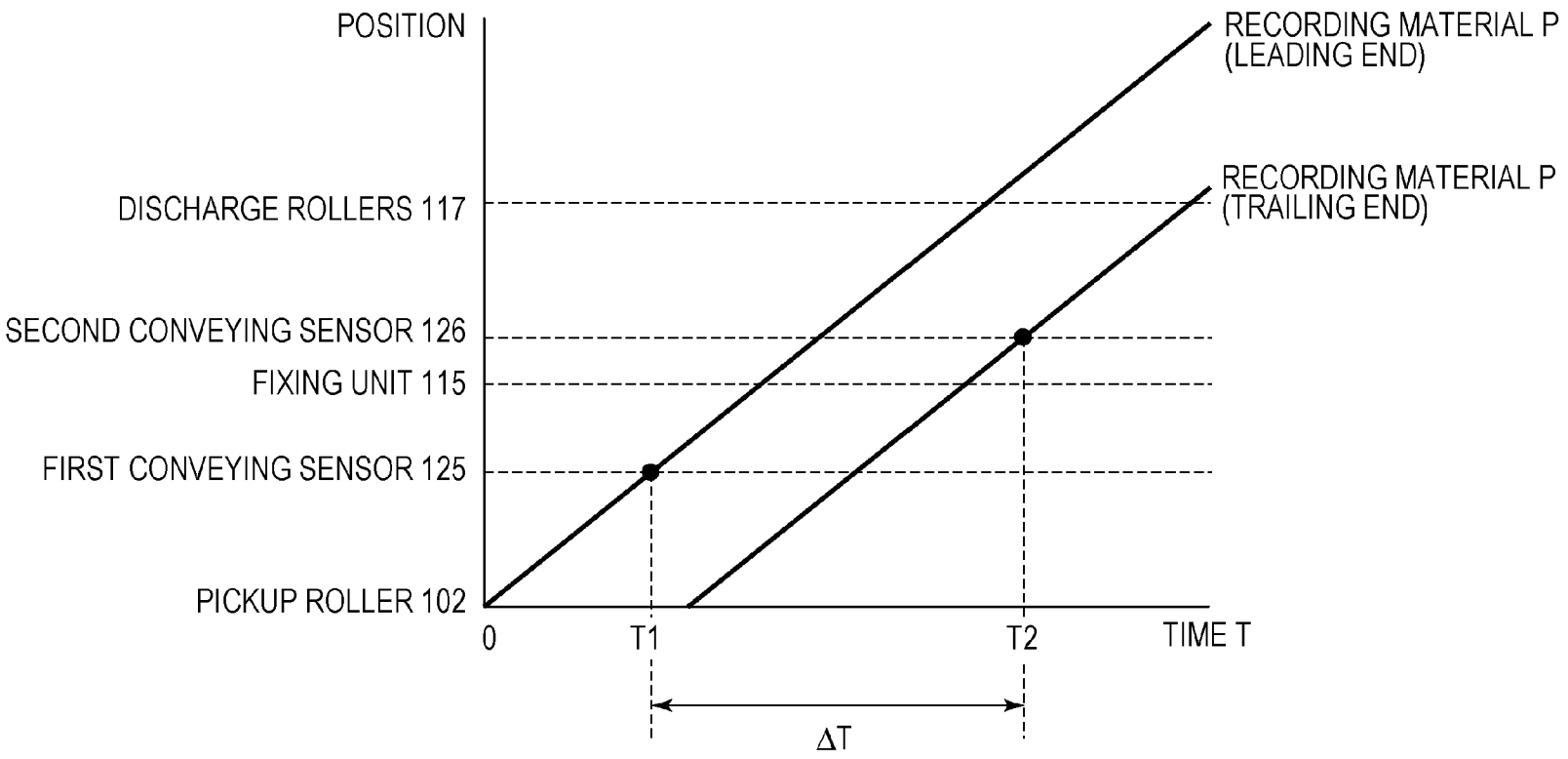
FIG. 4 is a diagram illustrating changes in a conveying state of a recording material during printing.

FIG. 4 is a diagram illustrating changes in the conveying state of the recording material P during printing according to the present embodiment. In FIG. 4, the recording material P in the paper cassette 101 is fed by the pickup roller 102 when time T=0. Thereafter, the recording material P passes through the first conveying sensor 125, the fixing unit 115, and the second conveying sensor 126 in this order and is discharged from the body A by the discharge rollers 117. As described above, the CPU 133 can measure time ΔT taken for the recording material P to pass through a conveying path including the fixing unit 115 using results of the detection performed by the first conveying sensor 125 and the second conveying sensor 126, which are provided upstream and downstream, respectively, of the fixing unit 115. In the present embodiment, the time ΔT is conveying time taken for the recording material P to pass through a conveying path extending from the first conveying sensor 125 to the second conveying sensor 126. More specifically, the conveying time is a period from when the first conveying sensor 125 detects a leading end of the recording material P to when a trailing end of the recording material P passes by the second conveying sensor 126. In the present embodiment, the time ΔT is represented as ΔT=T2−T1 as illustrated in FIG. 4. The CPU 133 obtains T1 and T2 based on the signals from the conveying sensors 125 and 126, respectively, in order to calculate the time ΔT.

Figure 5A:
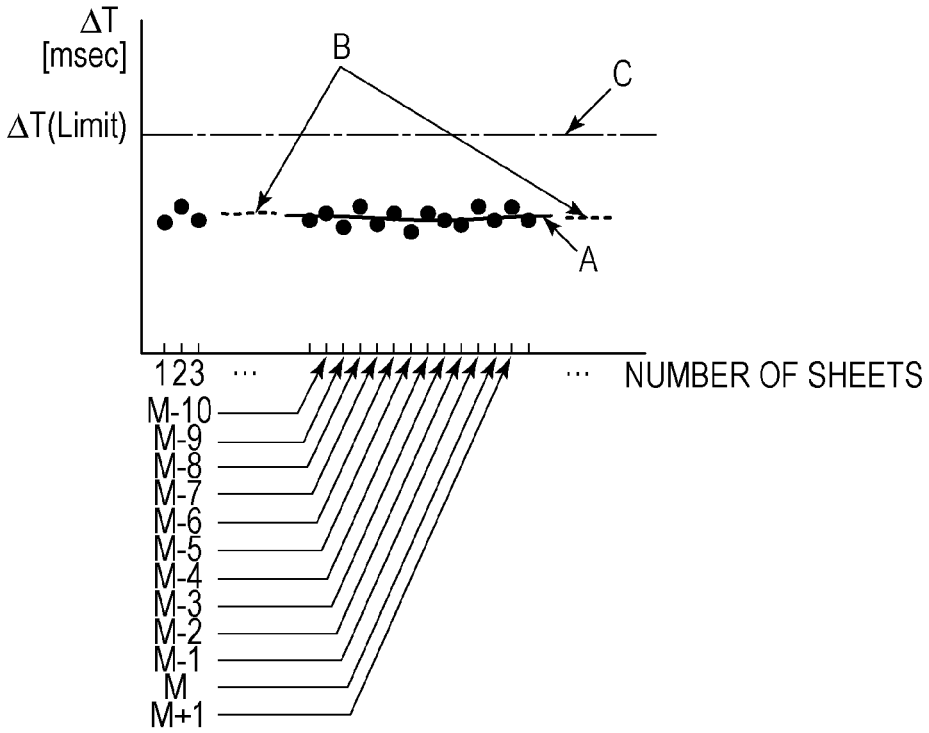
FIGS. 5A and 5B are diagrams illustrating relationships between the number of sheets of the recording material and time taken for the recording material to pass through a conveying path according to a first embodiment.

FIG. 5A illustrates an example in which the time ΔT of the recording material P measured by the CPU 133 is repeatedly plotted when the conveying speed of the recording material P during printing is constant. Curves (a solid line A and broken lines B) illustrated in FIG. 5A indicate ΔT(AVE), which is obtained by averaging the times ΔT of a plurality of last sheets (10 sheets in the present embodiment) measured by the CPU 133. The times ΔT of sheets M-10 to M-1 illustrated in FIG. 5A are averaged. If ΔT(AVE) indicated by the solid line A exceeds a predetermined threshold ΔT(Limit) (indicated by a dash-dot line C in FIG. 5A), the CPU 133 determines that the conveying performance of the fixing unit 115 has permanently deteriorated, that is, determines that the life of the fixing unit 115 has ended. The end of the life of the fixing unit 115 means that the fixing unit 115 needs to be replaced. A major factor in the permanent deterioration of the conveying performance of the fixing unit 115 after repeated use (also referred to as "endurance") is deterioration of the thermal grease applied to the surface of the ceramic heater 121 in contact with the fixing film 120. When the thermal grease deteriorates, the sliding performance between the ceramic heater 121 and the fixing film 120 decreases, thereby decreasing the performance of the fixing film 120 in conveying the recording material P. Other factors include deterioration of a surface of the pressure roller 122.

Figure 5B:
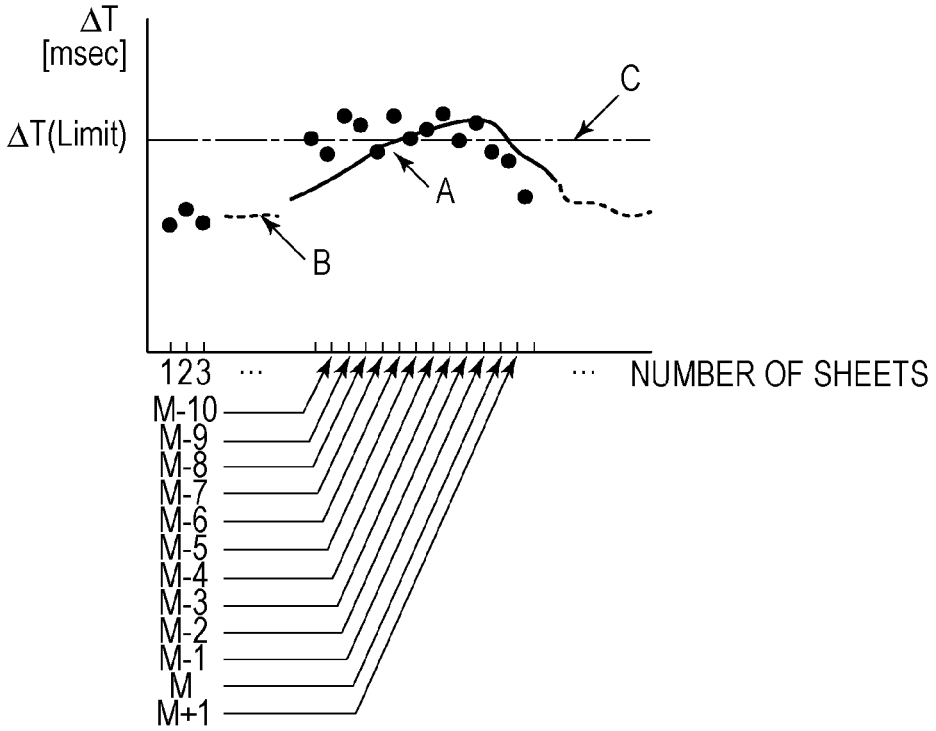

FIG. 5B illustrates an example in which the time ΔT significantly increases under certain printing conditions. The conveying performance of the fixing unit 115 can significantly change due to factors other than endurance. For example, such factors include an effect of water vapor generated when the recording material P containing moisture is heated by the fixing unit 115. The amount of moisture contained in the recording material P increases when the image forming apparatus is installed in a hot, humid environment. For example, water vapor generated by the fixing unit 115 might turn into drops of water on the surface of the pressure roller 122 in the fixing unit 115. In this case, the drops of water on the pressure roller 122 reduce friction between the recording material P and the pressure roller 122. As a result, the recording material P might slip while passing through the fixing unit 115, thereby decreasing the conveying performance. Thus, the conveying performance might deteriorate due to a change in the amount of moisture contained in the recording material P, as well as the endurance of the fixing unit 115. In order not to erroneously determine that the life of the fixing unit 115 has ended, the CPU 133 corrects the measured time ΔT in the following manner.

In the present embodiment, the CPU 133 monitors a result of the detection of humidity performed by the temperature/humidity sensor 119 during printing. The CPU 133 then corrects, in accordance with the result of the detection performed by the temperature/humidity sensor 119, the time ΔT measured when the recording material P is being conveyed. Since the time ΔT is corrected using at least humidity in the present embodiment, a humidity sensor (a sensor, which is not illustrated, capable of detecting only humidity) may be used, instead. The temperature/humidity sensor 119 adopted in the present embodiment or the humidity sensor is a sensor that outputs a signal indicating an analog voltage value. The CPU 133 digitizes the signal indicating an analog voltage value and temporarily stores the digitized signal in the storage section (the storage section 200*a* illustrated in FIG. 1A), which is not illustrated, as information regarding the environment. Alternatively, the time ΔT may be corrected using temperature, or the time ΔT may be corrected using temperature and humidity.

Figures 6A, 6B:
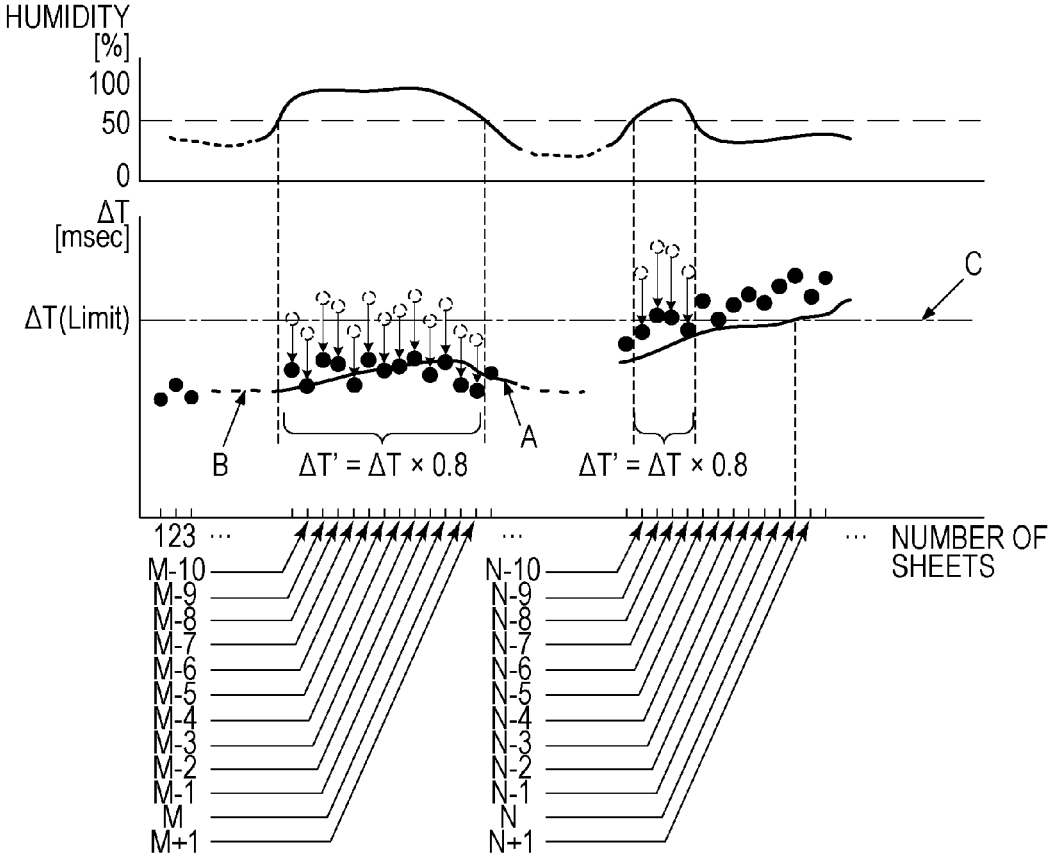
FIGS. 6A and 6B are diagrams illustrating a relationship between the number of sheets of the recording material and time taken for the recording material to pass through the conveying path after correction according to the first embodiment.

FIG. 6A illustrates an example of the humidity detected by the CPU 133 and the time ΔT of the recording material P repeatedly plotted during printing. As illustrated in FIG. 6B, if the humidity detected by the temperature/humidity sensor 119 is equal to or higher than 50%, that is, equal to or higher than a threshold, the CPU 133 corrects the time ΔT as time ΔT' (=ΔT×α; α=0.8 in the present embodiment), which is obtained by multiplying the time ΔT by α. In FIG. 6A, data regarding the time ΔT (hollow circles in FIG. 6A) measured when the humidity detected by the temperature/humidity sensor 119 is equal to or higher than 50% is corrected as ΔT' (solid circles in FIG. 6A). If αT(AVE) calculated from the time αT or αT' exceeds the threshold αT(Limit) (in FIG. 6A, an N-th sheet), the CPU 133 determines that the life of the fixing unit 115 has ended. In FIG. 6A, the times ΔT of the sheets M-10 to M-1 are averaged.

A procedure of the above-described determination whether the life of the fixing unit 115 has ended performed by the CPU 133 according to the present embodiment will be described with reference to a flowchart of FIG. 7. First, if the body A begins a printing operation in S701, the recording material P is fed from the paper cassette 101 and conveyed through the conveying path in the body A. In S702, the CPU 133 obtains the time ΔT of the conveyed recording material P based on the results of the detection performed by the first conveying sensor 125 and the second conveying sensor 126. In S703, the CPU 133 checks the humidity detected by the temperature/humidity sensor 119 and, if the humidity is equal to or higher than 50%, corrects the measured time ΔT as ΔT' in S704 (if the humidity is lower than 50%, the CPU 133 does not correct the time ΔT). In S705, the CPU 133 averages the times ΔT or ΔT' of last 10 sheets to obtain ΔT(AVE). ΔT(AVE) obtained as a result of the averaging is stored in the storage section (the storage section 200*a* illustrated in FIG. 1A) of the CPU 133 as information regarding the conveying time of the recording material P. Next, in S706, if ΔT(AVE)>ΔT(Limit), the CPU 133 determines in S707 that the life of the fixing unit 115 has ended and outputs (issues) information indicating that the life of the fixing unit 115 has ended, that is, information for requesting replacement of the fixing unit 115. In S709, the printing operation ends. On the other hand, if ΔT(AVE)≤ΔT(Limit) in S706 and there is a next sheet in S708, the process returns to S702. If ΔT(AVE)≤ΔT(Limit) in S706 and there is no next sheet in S708, the printing operation ends in S709.

Although only one correction coefficient is used in accordance with the detected humidity in the present embodiment, the number of correction coefficients is not limited to two. Three or more correction coefficients may be used instead. If the effect of humidity is reflected in the control more sensitively, the life of the fixing unit 115 can be determined more accurately even if humidity varies. Although the time ΔT is calculated using the two sensors, namely the first conveying sensor 125 and the second conveying sensor 126, in the present embodiment, the conveying time including time taken for the recording material P to pass through the fixing unit 115 can be measured using only the second conveying sensor 126. For example, a period from when the recording material P is fed to when the second conveying sensor 126 detects the recording material P may be measured and used for determining the life of the fixing unit 115. Alternatively, the time ΔT may be calculated from the measured period and used for determining the life of the fixing unit 115. In addition, as a method for more accurately measuring time taken for the recording material P to pass through a nip between the fixing film 120 of the fixing unit 115 and the pressure roller 122, a method in which the length of the recording material P in a conveying direction is measured may be used.

In the present embodiment, the conveying speed of the recording material P during printing is presumed to be constant. If it is possible to switch the speed at which the fixing unit 115 conveys the recording material P between a plurality of speeds in accordance with a printing mode, however, the same effect can be produced by correcting the time ΔT, the threshold ΔT(Limit), or the like in accordance with the determined conveying speed.

As described above, according to the present embodiment, the effect of changes in the performance of the fixing unit 115 in conveying the recording material P caused by factors other than endurance can be reduced in the detection of deterioration of the conveying performance of the fixing unit 115, which is the conveying unit. As a result, the life of the fixing unit 115 can be accurately determined.

Second Exemplary Embodiment

In the present exemplary embodiment, the effect of significant changes in the conveying performance of the fixing unit 115 caused by water vapor is reduced. As described above, water vapor generated when the recording material P is heated is a major factor in a significant change in the conveying performance of the fixing unit 115. In the present embodiment, a condition under which water vapor generated from the recording material P is likely to turn into drops of water on the surface of the pressure roller 122 in the fixing unit 115 is added as a condition under which the time ΔT is corrected.

Figure 8:
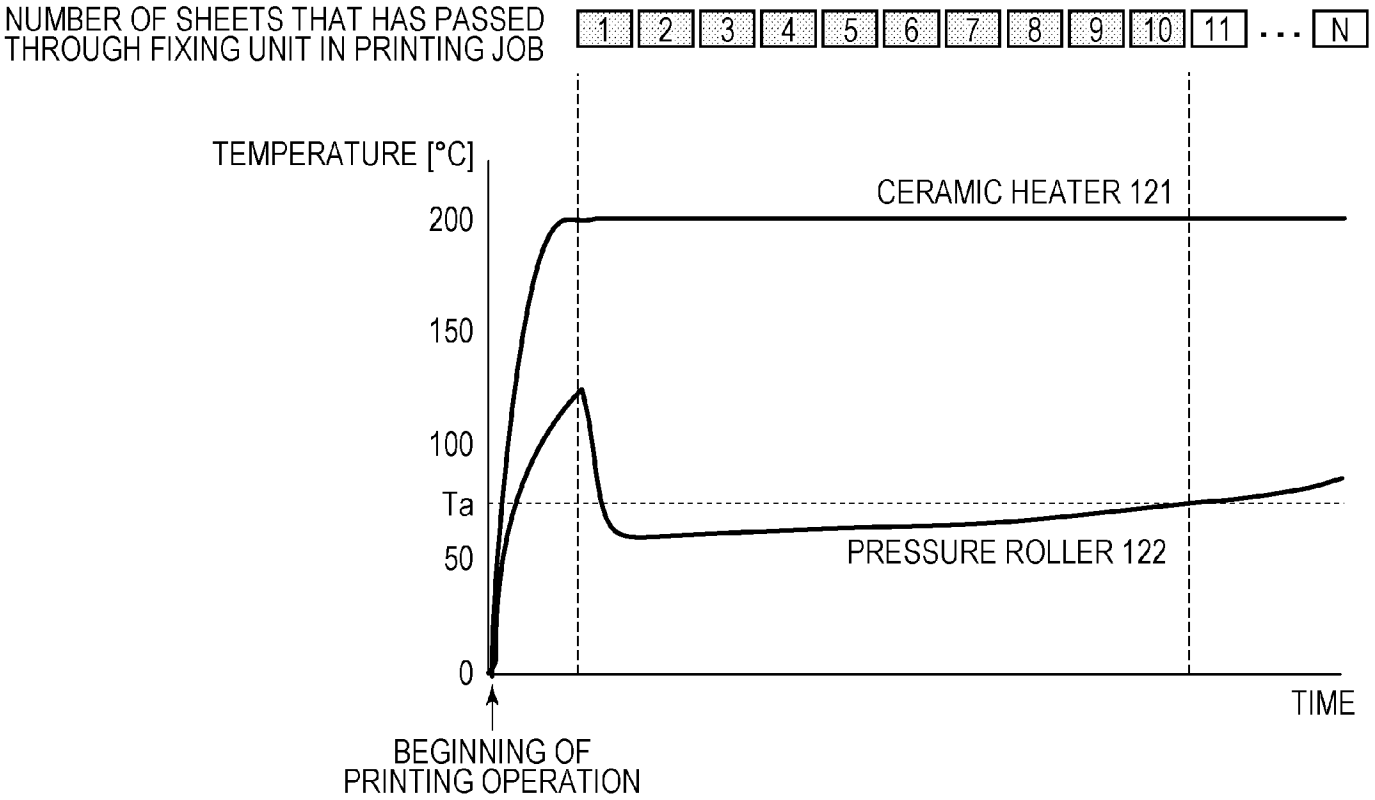
FIG. 8 is a diagram illustrating a relationship between the number of sheets of the recording material and the temperature of a pressure roller according to the second embodiment.

FIG. 8 illustrates a relationship between changes in the temperature of the ceramic heater 121 and the pressure roller 122 after a printing operation begins and the number of sheets of the recording material P that have passed through the fixing unit 115. In FIG. 8, after the printing operation begins, the ceramic heater 121 heats until the temperature thereof reaches a certain value (in the present embodiment, 200° C.) before the recording material P reaches the fixing unit 115. At this time, the temperature of the pressure roller 122 also increases gradually. When a first sheet of the recording material P reaches the fixing unit 115, the temperature of the pressure roller 122 decreases because the recording material P draws heat from the pressure roller 122. Thereafter, the temperature of the pressure roller 122 gradually increases as the printing operation continues.

If the temperature of the pressure roller 122 is low, water vapor generated from the recording material P is cooled and likely to turn into drops of water on the pressure roller 122. In the present embodiment, variations in the environment, the components of the fixing unit 115, power supplied to the fixing unit 115, and the like are taken into consideration. In consideration of these conditions, it is presumed in the present embodiment that when the temperature of the pressure roller 122 is less than or equal to a threshold temperature Ta=70° C., drops of water are likely to form on the pressure roller 122. In the example of changes in the temperature of the pressure roller 122 illustrated in FIG. 8, the temperature of the pressure roller 122 becomes less than or equal to the threshold temperature Ta (=70° C.), when drops of water are likely to form on the pressure roller 122. In FIG. 8, drops of water are likely to form on the pressure roller 122 in first 10 sheets after the beginning of formation of an image (printing).

That is, the possibility of a sudden slip changes between the first 10 sheets after the beginning of the printing and eleventh and later sheets (a sudden slip is more likely to occur during the printing operation for the first 10 sheets). Therefore, the correction coefficient changes when a certain period of time has elapsed since the beginning of the printing.

In the present embodiment, a correction coefficient table illustrated in FIG. 9 that takes into consideration information regarding the number of sheets subjected to the printing operation since the beginning of printing is added to a correction coefficient table illustrated in FIG. 6B, which has been referred to in the first embodiment. Although the correction coefficient changes from a first coefficient to a second coefficient after the tenth sheet is subjected to the printing operation, the timing at which the correction coefficient changes may be different depending on the configuration of the fixing unit 115.

Figure 10:
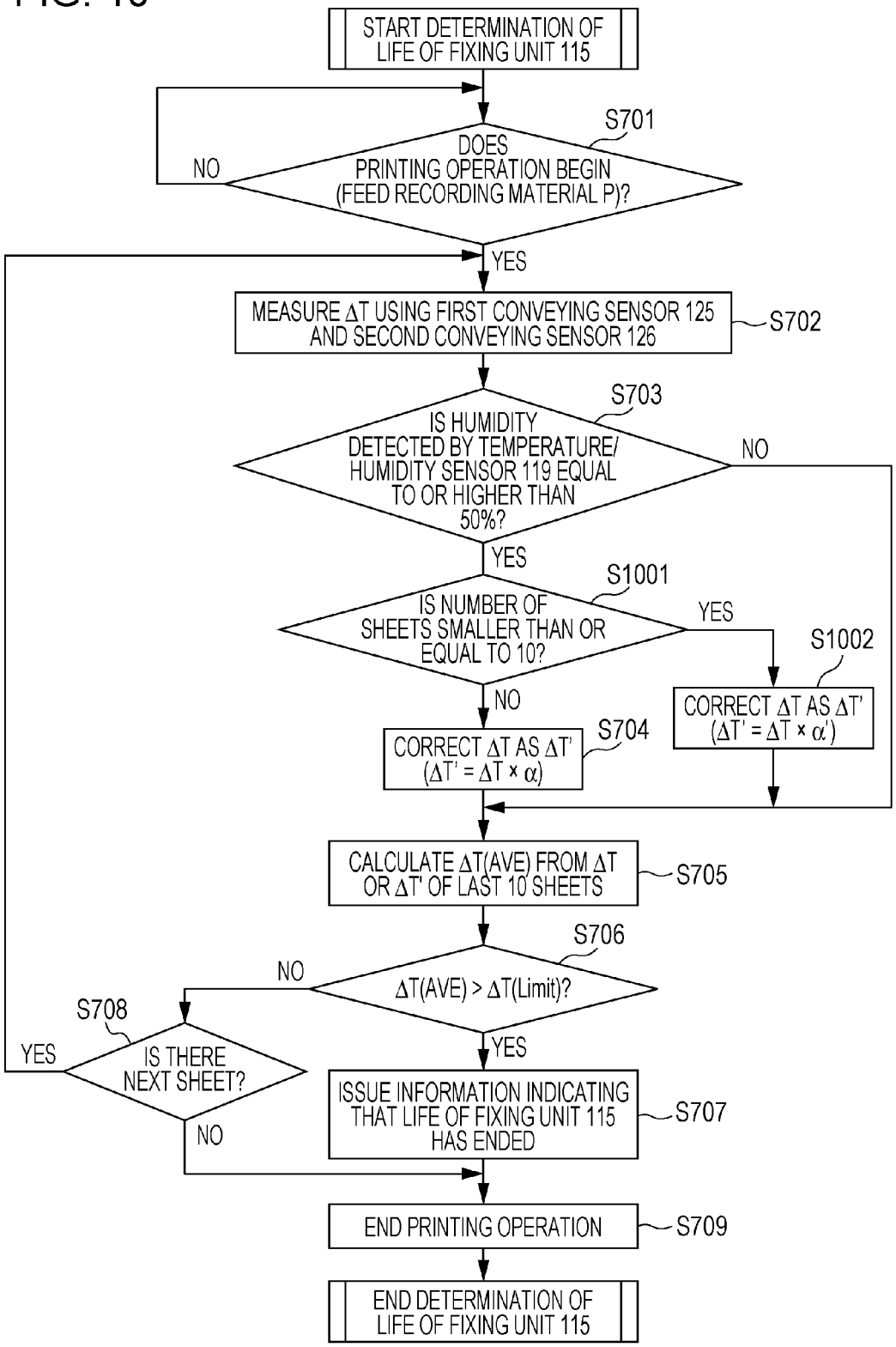
FIG. 10 is a flowchart according to the second embodiment.

A procedure of the determination whether the life of the fixing unit 115 has ended according to the present embodiment will be described with reference to a flowchart of FIG. 10. Here, only S1001 and S1002, which are newly added to the flowchart of FIG. 7, will be described.

Figure 7:
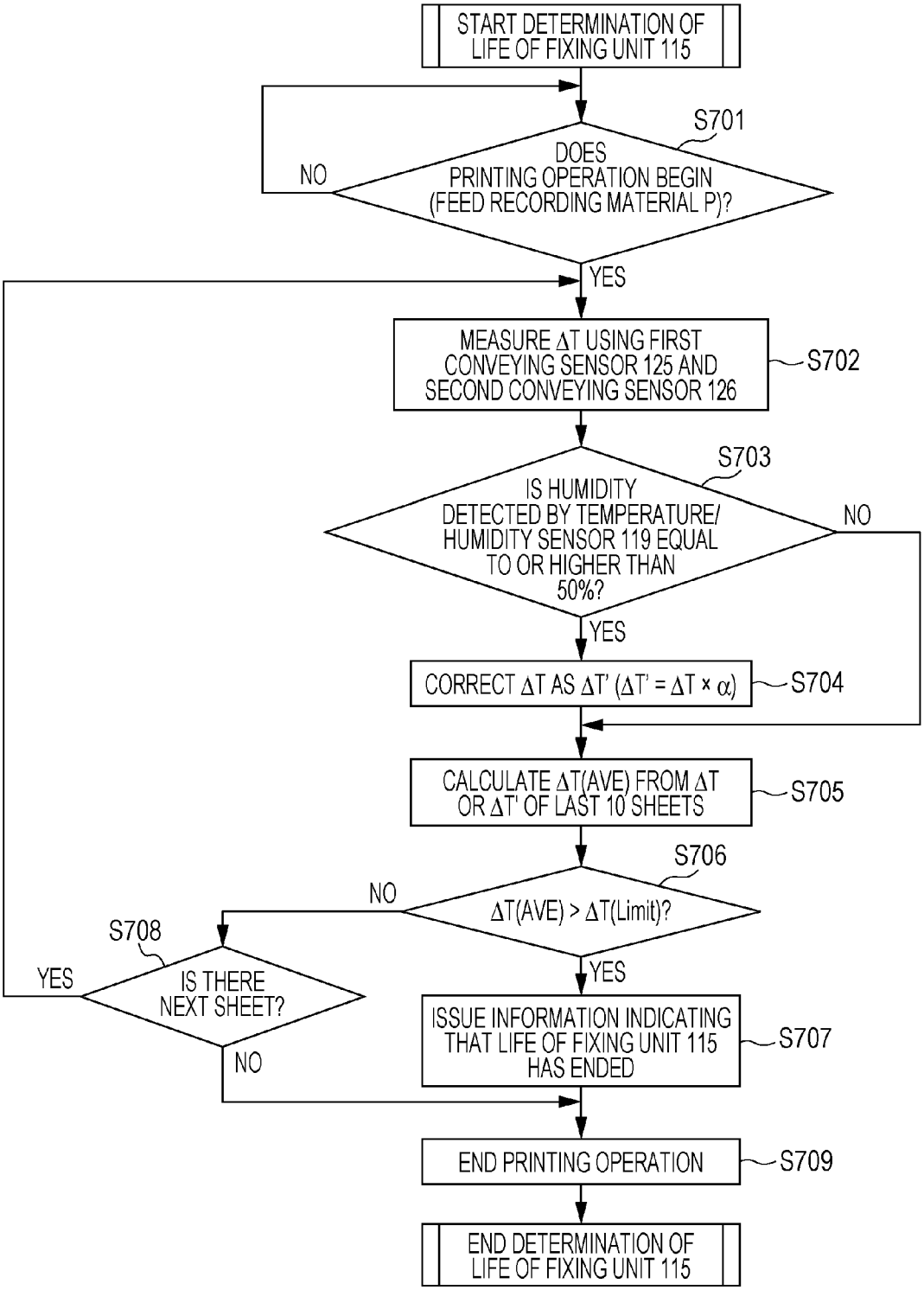
FIG. 7 is a flowchart according to a second embodiment.

The procedure until S703 is the same as that illustrated in FIG. 7. In S703, the CPU 133 checks the humidity detected by the temperature/humidity sensor 119 and, if the humidity is equal to or higher than 50%, that is, greater than or equal to the threshold, checks the number of sheets subjected to the printing operation in a job in S1001. If the number of sheets of the recording material P subjected to the printing operation is larger than 10, the time $\Delta T$ is corrected as $\Delta T'$ using the correction coefficient $\alpha$ in S704. If the number of sheets of the recording material P subjected to the printing operation is less than or equal to 10, the time $\Delta T$ is corrected as $\Delta T'$ using a correction coefficient $\alpha'$ in S1002. The procedure in S705 and later steps are the same as that illustrated in FIG. 7.

In the present embodiment, as illustrated in FIG. 9, one of the three correction coefficients is used depending on the detected humidity and the result of the determination whether the number of sheets subjected to the printing operation has reached a certain value. However, the correction coefficient may change for each sheet conveyed. In addition, if the correction coefficient is determined based on the humidity of the environment or the number of sheets subjected to the printing operation, the effect according to the present embodiment can be produced.

Thus, by taking into consideration the number of sheets subjected to the printing operation after the beginning of the printing in the control according to the first embodiment, the effect of significant changes in the conveying performance can be reduced. As a result, whether the life of the fixing unit 115 has ended can be accurately determined.

Other Embodiments

A timing at which the detection of deterioration (end of life) of the conveying performance of the fixing unit 115 described in the first or second embodiment is performed will be described. If deterioration of the conveying performance of the fixing unit 115 can be detected before an expected timing of the end of the life of the fixing unit 115, the fixing unit 115 can be replaced at an appropriate timing.

Therefore, for example, the control described in the first or second embodiment is performed at an early timing (for example, an M-th sheet (M<N) in FIG. 6A) for the fixing unit 115 whose life is expected to end at the N-th sheet as illustrated in FIG. 6A.

Although the timing at which the determination of the life of the fixing unit 115 is defined by the number of sheets subjected to the printing operation in the present embodiment, the timing may be defined by another condition (the total driving time of the fixing unit 115 or the like), instead.

Figure 11:
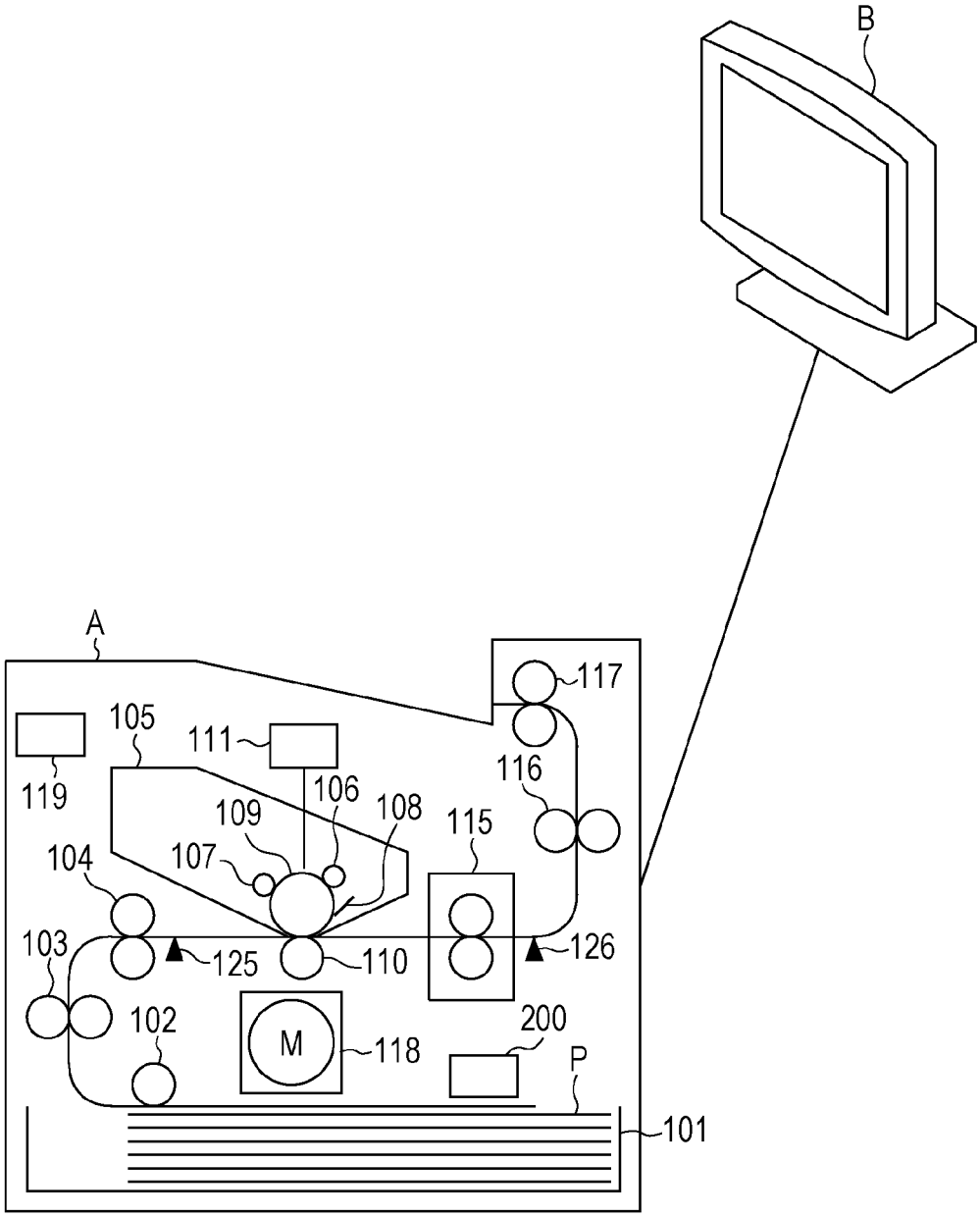
FIG. 11 is a diagram illustrating another embodiment.

As illustrated in FIG. 11, the result of the determination of the life of the fixing unit 115 described above may be automatically transmitted, through a network, to an external apparatus (a computer B) owned by a manufacturer who has provided the image forming apparatus A. Because the result of the determination is transmitted to the manufacturer based on an expected life of the fixing unit 115 determined in accordance with an environment in which a user uses the image forming apparatus A, a timing at which the manufacture dispatches a new fixing unit can be optimized. In addition, since the manufacture can dispatch the new fixing unit to the user in a timely manner, usability improves.

For example, a second threshold $\Delta T2$ ($=\Delta T(\text{Limit})\times 0.9$), which is smaller than $\Delta T(\text{Limit})$, may be set as the timing at which the result of the determination is transmitted through the network. It is effective to transmit the result of the determination if the second threshold $\Delta T2$ is exceeded.

Although the fixing unit is taken as an example of the conveying unit in the first and second embodiments, the conveying unit is not limited to the fixing unit. The above-described control may be applied to any member whose performance in conveying a recording material varies depending on the environment (humidity, temperature, and the like). For example, in the case of a conveying roller that conveys a recording material, the conveying performance of the conveying roller can decrease if humidity is high and the recording material collects moisture. In this case, too, if a threshold is set for humidity and a detected humidity exceeds the threshold, deterioration (end of life) of the conveying roller can be accurately determined by correcting time taken for the conveying roller to convey the recording material. In this case, correction is performed such that the time taken for the conveying roller to convey the recording material becomes shorter.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2014-086848 filed Apr. 18, 2014, which is hereby incorporated by reference herein in its entirety.

What is claimed is:

1. An image forming apparatus comprising:

a conveying unit to convey a recording material;

a fixing unit configured to fix an image onto the recording material conveyed by the conveying unit;

an obtaining unit configured to obtain first information regarding conveying time taken to convey the recording material from a first position located upstream of a conveying direction of the recording material with respect to the fixing unit to a second position located downstream of the conveying direction of the recording material with respect to the fixing unit;

a detection unit configured to detect second information regarding humidity; and a control unit configured to determine, based on the first information, whether a life of the fixing unit has ended or not, wherein the control unit corrects the first information based on the second information.

2. The image forming apparatus according to claim 1, wherein, if the humidity corresponding to the second information is greater than or equal to a threshold, the control unit corrects the first information.

3. The image forming apparatus according to claim 2, wherein, until a certain period of time has elapsed since formation of the image on the recording material began, the control unit corrects the first information using a first coefficient and, after the certain period of time elapses, the control unit corrects the first information using a second coefficient, which is greater than the first coefficient.

4. The image forming apparatus according to claim 1, further comprising:

a first sensor configured to detect the conveyed recording material at the first position; and a second sensor configured to detect the conveyed recording material at the second position, wherein the control unit calculates the information regarding the conveying time based on results of the detection of the first sensor and the second sensor.

5. The image forming apparatus according to claim 1, wherein the fixing unit is replaceable, and wherein, if the control unit determines that the life of the fixing unit has ended, the control unit outputs information for requesting replacement of the fixing unit.

6. The image forming apparatus according to claim 1, wherein the control unit transmits information regarding a timing at which the life of the fixing unit has ended.

7. The image forming apparatus according to claim 1, wherein the control unit calculates the first information by averaging conveying times of a plurality of sheets of the recording material at a time when the plurality of sheets of the recording material are conveyed.

8. The image forming apparatus according to claim 1, wherein the fixing unit includes a film provided with a heater and a pressure roller and fixes the image onto the recording material when the recording material is conveyed to a nip between the film and the pressure roller.

9. The image forming apparatus according to claim 1, further comprising:

an image forming unit configured to form an image on an image bearing member, wherein the image forming unit includes a transfer section that transfers the image formed on the image bearing member onto the recording material.

10. The image forming apparatus according to claim 1, further comprising:

an external apparatus configured to communicate with the image forming apparatus, wherein the control unit transmits, to the external apparatus, a result of the detection if the life of the fixing unit is determined to have ended.

* * * * *